US005484022A

United States Patent [19]

Coutts et al.

[11] Patent Number: 5,484,022

[45] Date of Patent: Jan. 16, 1996

[54] TUBING TEST VALVE

[75] Inventors: Graeme F. Coutts; Jeffrey C. Edwards, both of Scotland, United Kingdom

[73] Assignee: Exploration & Production Services (North Sea) Ltd., United Kingdom

[21] Appl. No.: 190,054

[22] PCT Filed: Jul. 23, 1992

[86] PCT No.: PCT/GB92/01351

§ 371 Date: Mar. 25, 1994

§ 102(e) Date: Mar. 25, 1994

[87] PCT Pub. No.: WO/9303255

PCT Pub. Date: Feb. 18, 1993

[30] Foreign Application Priority Data

Aug. 8, 1991 [GB] United Kingdom ..... 9117119

[51] Int. Cl.[6] ..... E21B 34/10

[52] U.S. Cl. ..... 166/336; 166/324

[58] Field of Search ..... 166/72, 319, 321, 166/324, 326, 363; 137/596.14, 629; 251/347

[56] References Cited

U.S. PATENT DOCUMENTS

| | | | |
|---|---|---|---|
| 3,870,101 | 3/1975 | Helmus | 166/322 X |
| 3,993,136 | 11/1976 | Mott | 166/375 |
| 4,103,744 | 8/1978 | Akkerman | 166/324 |
| 4,143,712 | 3/1979 | James et al. | 166/321 X |
| 4,234,043 | 11/1980 | Roberts | 166/319 X |
| 4,260,021 | 4/1981 | Mott | 166/318 |
| 4,289,205 | 9/1981 | Mott | 166/377 |
| 4,293,034 | 10/1981 | Mott | 166/208 |
| 4,295,523 | 10/1981 | Mott | 166/250 |
| 4,306,623 | 12/1981 | Brooks | 166/322 |
| 4,310,048 | 1/1982 | Mott | 166/377 X |
| 4,319,639 | 3/1982 | Mott | 166/377 |
| 4,325,409 | 4/1982 | Roberts | 166/321 X |
| 4,325,434 | 4/1982 | Roberts | 166/321 |
| 5,012,871 | 5/1991 | Pleasants et al. | 166/185 X |

*Primary Examiner*—Roger J. Schoeppel

*Attorney, Agent, or Firm*—Gifford, Krass, Groh, Sprinkle, Patmore, Anderson & Citkowski

[57] ABSTRACT

A tubing test valve (34, 34*a*) is described for use with a drill string (20) for pressure testing tubulars and downhole equipment, particularly in a cased hole (12) which has a permanent packer (16) fitted. The valve (34) permits self-filling during running-in, but allows pressure testing when stationary in the well (1). The valve (34) also permits multiple entry of the string to, and retrieval from, permanent packers without committing the tool to the locked open position. This is achieved by providing an apertured ball valve (50, 50*a*) in the tool housing (42, 42*a*) which can be moved axially and rotated with the bore (70A, 71A) of the housing (42, 42*a*). The ball valve has side orifices (54, 54*a*) and a top orifice (52*a*) which controls flow through the valve (34, 34*a*). In one embodiment the ball element (50) is suspended by coil spring (64) above the lower valve seat (56) during running-in and is closed for pressure testing by pressuring with fluid from above. In another embodiment the ball element (50*a*) is biased by a spring (66*a*) into engagement with the valve seat (56*a*) when stationary to allow pressure testing during running as the flow of fluid lifts the ball (50*a*) off its seat (56*a*) to allow self-filling. In both embodiments the ball element (50, 50*a*) contains slots (58, 58*a*) mounted on pins (62, 62*a*) which allow the ball to be rotated when the tool is in the packer (16) when engaging the valve seat (56, 56*a*) to break the seal and allow pressure in the bore above (71A) and below (70A) the ball element (50, 50*a*) to equalise. This allows the tool to be withdrawn from the packer (16).

26 Claims, 3 Drawing Sheets

TUBING TEST VALVE

FIELD OF THE INVENTION

The present invention relates to a valve for use in a drill string for pressure testing tubulars and downhole test equipment for use with tubulars.

Particularly, but not exclusively, the invention relates to a valve for testing tubulars in a cased hole which has a permanent packer fitted.

BACKGROUND OF THE INVENTION

In order to test a well with a permanent packer set inside a casing, a test string is required to be made up for running in the well. A test string typically includes, but is not limited to, the following components, in order, from the bottom up. A bullnose or wire-line re-entry guide, a packer seal assembly, a locator no-go, a tubing test valve, various testing and safety valves and tubulars of sufficient length to reach the set casing permanent packer. Because the permanent packer is pre-set and the packer forms part of the casing downhole, the test string length is determined by the following factors; tubing length and size—each length being individually measured, and the temperature and stretch of the tubing in the well. The test string length must correspond to the packer depth almost exactly.

To try and pre-calculate the amount of pipe required to exactly enter a permanent packer, and be correct within inches, is impossible in practice. The standard technique used is therefore to calculate the pipe requirement approximately, and then enter the packer bore until pipe will not enter any further. This is the point when the locator no-go abuts the top of the permanent packer and this can be detected on the drilling rig. From this known point and a second known point which is the location of the formation top surface, i.e. the sea bed or land surface, the complete test string can be spaced out as required. This is typically done by painting a section of pipe white and closing a set of pipe rams contained in the drilling BOP stack to give it an exact mark. Using this marking the pipe can be spaced out as necessary to include well test equipment such as a subsea test tree and other tools. During this space-out the string is run-in until the locator no-go abuts the top of the packer; the string is then withdrawn several feet, for example 10 feet from the packer, so that there is a good seal between the packer seal assembly and the interior surface of the packer called the polished bore receptacle (PBR). This packer seal assembly includes alternate bands of metal and elastomer, usually "VITON" (trademark) seals, so that slight movements relative to the PBR do not effect the seal in between the tool and the permanent packer.

Existing tubing test valves allow the mud/fluid contained within the casing to freely enter the test string as the test string is lowered downhole by adding each section/length of tubular. A typical tubing test valve currently used is the Halliburton TST (Tubing String Tester) valve which allows the DST string to be pressure tested while running in the hole. The Halliburton TST valve includes a flapper valve and spring so that when running in the hole the flapper valve opens and allows the test string to fill up. When the test string is stationary the flapper valve is held closed by the spring. The string can be pressure tested as many times as required while running in the hole. With valves of this type the tubulars can be internally tested by pumping down inside the test string on top of the tubing test valve. The pressure is monitored at the surface and pressure testing verifies the pressure integrity of the connections of the tubulars and assemblies above the tubing test valve. Therefore, the pressure test procedure can be repeated as many times as desired until all tubulars are added to give the full length of the test string. As described above, the full length of the test string is determined by the space out from the locator no-go. Once the full length of the string has been determined then various test tools can be added to the string as required in order to permit safe testing of the well.

Therefore, the procedure is to run-in to determine the length of tubulars and test equipment and during run-in the test valve is free to permit fluid passage, but when stationary the test valve is closed and must support pressure from above to pressure test the connections of tubulars and the like. Once the space out has been achieved and the location of the packer known, the test string must be partially retrieved where additional equipment is then fitted and the string run in again and the testing procedure can be repeated to check the integrity of the additional well test components.

Existing tubing test valves allow the seal assembly to enter the set packer by permitting fluid/pressure by-pass to the now engaged seals as they compress what may be a closed volume below the packer. The volume below the packer may be closed because the casing/formation has not been perforated or the formation may be sufficiently impermeable such that the volume is effectively closed. If the volume is closed, the tool may get stuck in the well because of the enormous hydraulic force created by trying to pull the engaged seals or the set packer against the closed volume below. In extreme cases this could result in equipment loss or in the well being abandoned.

One existing solution is to provide fluid by-pass communication between the exterior and interior of the tubing and require hydraulic actuation from annulus pressure.

In an alternative arrangement it is possible to run two test valves in series, for example, a Halliburton TST valve with a Halliburton LPN-NR formation tester valve beneath it. However, the LPR-NR valve does not allow self-filling and needs to be held open during run-in. However, use of the LPR formation tester valve in this application is out in this design mode and may compromise the operation of the tool during the mode downhole. In this regard, during initial run-in the LPR is held open and the TST permits self-filling to the string and pressure testing of the tubulars and components. After location of the no-go and proper space out, the TST has to be fired open. This means that to pressure test the well equipment, the LPR-N has to be closed. If the LPR fails it will automatically close and it may not be possible to by-pass the pressure between the closed formation and the interior of the tubing. This arrangement does not permit multiple re-entry of the tool or fluid by-pass.

An object of the present invention is to provide an improved tubing test valve which obviates or mitigates at least one of the aforementioned disadvantages.

A further object of the present invention is to provide a tubing test valve which permits multiple entry of the string to, and retrieval from, permanent packers without committing the tool to the locked open position.

SUMMARY OF THE INVENTION

This is achieved by providing a tubing test valve which includes a rotatable valve, preferably a ball valve, in the tool which will only support pressure from above and which allows completion fluid to freely enter the test string during running operations, but which permits the pressure testing of tubulars and components from above when the tool is stationary. When the tool is used in conjunction with permanent packer systems, the rotatable valve permits fluid by-pass from both entering and retrieving from the packer.

According to one aspect of the present invention there is provided a tubing test valve comprising:

a valve housing;

a rotatable valve element disposed in the valve housing, said rotatable valve element being rotatable and axially moveable along the longitudinal axis of the tool;

valve element positioning means for positioning the valve element axially above a valve seat during running-in a well, and for positioning the valve element to engage the valve seat when the tubing test valve is stationary in the well to allow pressure testing of components above the ball element, and resiliently-biased valve cage means for supporting said rotatable valve element in said housing, said resiliently-biased cage means being axially moveable for rotating the valve element in response to an upward pull on said tool when located in said packer, whereby the valve element is rotated to a partly open position whereby pressure across the valve element is equalised and the tool can be withdrawn from the packer.

Preferably the valve element positioning means is spring means coupled between the ball and upstream ball cage means, said spring means being biased to raise said ball element off said valve seat when running-in said well, said spring means allowing said ball element to engage said valve seat when fluid is pumped through said housing from above. Conveniently, the spring means is provided by two coil springs.

Alternatively, the valve element positioning means is a spring means disposed, in use, above the valve element and arranged to bias said valve element into engagement with the valve seat when the tubing test valve is stationary in the well, and said spring means allows fluid in said well to push said ball element from the valve seat during running-in whereby well fluid can flow through said tubing test valve.

Conveniently, the spring means is a coil spring coupled to an upper valve seat for forcing said upper valve seat into engagement with the top surface of said ball element when said valve is stationary in the well.

According to yet a further aspect of the present invention there is provided a tubing test valve comprising:

a valve housing;

a rotatable valve element disposed in said valve housing, said rotatable valve element being rotatable and being axially moveable along the longitudinal axis of the tool;

spring means for biasing said rotatable valve element off a valve seat when running the tool in a well to allow fluid to freely enter the test string, said spring means being responsive to fluid pumped through said valve housing to close said rotatable valve element when the tool is stationary in the well, and resiliently-biased valve cage means for supporting said rotatable valve element in said housing, said resiliently-biased cage means being axially moveable for rotating the valve element in response to an upward pull on said tool when located in said packer whereby the valve element is rotated when seated to a partly open position whereby pressure across the valve element is equalised and the tool can be withdrawn from the packer.

Preferably, the valve element is a ball valve element. Alternatively, the valve element is a plug valve element.

Conveniently the spring means is a pair of coil springs coupled between the ball element or the ball cage means and the resiliently-biased ball cage means includes a second coil spring.

Conveniently the test valve includes pressure sensor means which are actuatable in response to a pre-determined annulus pressure to lock the tubing test valve fully open when the tool is withdrawn from the packer.

Conveniently the ball valve element includes generally J-shaped slots oriented at an oblique angle to the longitudinal axis of the tool, for receiving spigots from said resiliently-biased ball cage means to permit rotation of the ball element, the arrangement being such that, in response to an upward movement of said ball cage means, the ball valve element is rotated to be clear of the lower valve seat so that the ball valve is partly open and pressure above and below the ball element is equalised. After pressure is equalised the ball cage is moved downwards by restoring spring force to close the ball valve. As the drill string continues to be pulled up the process is repeated so that the ball valve oscillates between a partially open and a closed position.

Conveniently the resiliently-biased ball cage means includes first and second annular pistons disposed downstream of the ball valve, said annular pistons being axially moveable within said valve housing, and means for comparing the internal and external pressures of the tubing beneath the permanent packer whereby, in response to upward pull on the tool when in the permanent packer, a pressure differential is created between the inside and outside of the tubing and the pistons are forced up to cause the ball element to rotate to a partly open position and allow withdrawal of the tool from the permanent packer.

Conveniently the ball valve seats on an annular metal seal so that metal-to-metal seals are provided by said tubing test valve.

According to a further aspect of the present invention there is provided a tubing test valve comprising:

a valve housing;

a ball valve element mounted in said valve housing, said ball valve element being coupled by spring means to a ball cage so as to be biased off a lower annular valve seat, said ball valve element having at least one aperture in the side of the ball and at least one aperture in the top of the ball, the apertures being connected by a channel, the arrangement being such that, in use, when the ball valve element is disposed off the valve seat such that the ball surface/valve seat interface is interrupted, the ball valve is open and during running-in of the tool, well fluid can flow through said valve, and when the tool is stationary and pressure is applied to the ball element from above, it seats on the valve seat whereby, when the ball valve element is rotatably displaced from the annular valve seat such that the ball surface/valve seat interface is interrupted, the ball valve element is opened and fluid may pass in one direction passed said annular valve seat through said side aperture, said channel and out through said top aperture.

Preferably, said ball element includes at least two side apertures connected by a common channel and one top aperture which is connected by a second channel to said common channel.

Preferably, said ball valve element includes at least two side apertures substantially transversely connected to said side apertures, side slots being adapted to receive spigots for retaining the ball valve element in a ball cage assembly whereby the ball valve element is free to rotate and move axially by a limited amount within said valve housing.

Preferably also, the ball element is coupled to the ball cage by two coil springs. The side slots are generally J-shaped.

According to a yet further aspect of the present invention there is provided a tubing test valve comprising:

a valve housing;

a rotatable valve element disposed in said valve housing, said rotatable valve element being rotatable and being axially moveable along the longitudinal axis of the tool;

first spring means for permitting said rotatable valve element to move axially when running the tool in a well to allow fluid to freely enter the test string, said first spring means closing said rotatable valve element when the tool is stationary in the well, and resiliently-biased valve cage means for supporting said rotatable valve element in said housing, said resiliently-biased cage means being axially moveable for rotating the valve element in response to an upward pull on said tool when located in said packer whereby the valve element is rotated to a partly open position whereby pressure across the valve element is equalised and the tool can be withdrawn from the packer.

Preferably, the valve element is a ball valve element. Alternatively, the valve element is a plug valve element.

Conveniently the first spring means is a first coil spring and resiliently-biased ball cage means includes a second coil spring.

Conveniently the test valve includes pressure sensor means which are actuatable in response to a pre-determined annulus pressure to lock the tubing test valve fully open when the tool is withdrawn from the packer.

Conveniently the ball valve element includes slots oriented at an oblique angle to the longitudinal axis of the tool, for receiving spigots from said resiliently-biased ball cage means to permit rotation of the ball element, the arrangement being such that, in response to an upward movement of said ball cage means, the ball valve element is rotated to be clear of the lower valve seat so that the ball valve is partly open and pressure above and below the ball element is equalised. After pressure is equalised the ball cage is moved downwards by restoring spring force to close the ball valve. As the drill string continues to be pulled up the process is repeated so that the ball valve oscillates between a partially open and a closed position.

Conveniently the resiliently-biased ball cage means includes first and second annular pistons disposed downstream of the ball valve, said annular pistons being axially moveable within said valve housing, and means for comparing the internal and external pressures of the tubing beneath the permanent packer whereby, in response to upward pull on the tool when in the permanent packer, a pressure differential is created between the inside and outside of the tubing and the pistons are forced up to cause the ball element to rotate to a partly open position and allow withdrawal of the tool from the permanent packer.

Conveniently the ball valves seats on a annular metal seal so that metal-to-metal seals are provided by said tubing test valve.

According to another aspect of the present invention there is provided a method of withdrawing a test string from a permanent packer, said method comprising the steps of;

providing a tubing test valve with a rotatable valve element therein, said rotatable valve element being rotatable and axially moveable within the test valve housing, pulling upwards on the tool when in said permanent packer to create a pressure differential between the interior and exterior of the tool beneath said permanent packer, and using said differential pressure to open said valve to equalise the pressure above and below the ball valve within the tubing test valve to permit the downhole tool to be withdrawn from the permanent packer.

According to a further aspect of the present invention, there is provided a ball valve for holding pressure in one direction and allowing free flow in the other direction comprising:

a valve housing;

a ball valve element mounted in said valve housing, said ball valve element resting on an annular valve seat, said ball valve element having at least one aperture in the side of the ball and at least one aperture in the top of the ball, the aperture being connected by a channel, the arrangement being such that, in use, when the ball valve element is disposed on the valve seat such that the ball surface/valve seat interface is not interrupted, the ball valve is closed and when the ball valve element is axially rotatably displaced from the annular valve seat such that the ball surface/valve seat interface is interrupted, the ball valve element is open and fluid may pass in one direction passed said annular valve seat through said side aperture, said channel and out through said top aperture.

Preferably, said ball element includes at least two side apertures connected by a common channel and one top aperture which is connected by a second channel to said common channel.

Preferably, said ball valve element includes at least two side apertures substantially transversely connected to said side apertures, side slots being adapted to receive spigots for retaining the ball valve element in a ball cage assembly whereby the ball valve element is free to rotate and move axially by a limited amount within said valve housing.

BRIEF DESCRIPTION OF THE DRAWINGS

These and other aspects of the invention will become apparent from the following description when taken in combination with the accompanying drawings in which:

FIG. 4 is an enlarged side view of the ball valve shown in FIG. 3 being in the raised position during running-in;

DETAILED DESCRIPTION OF THE PREFERRED EMBODIMENTS

Figure 1:
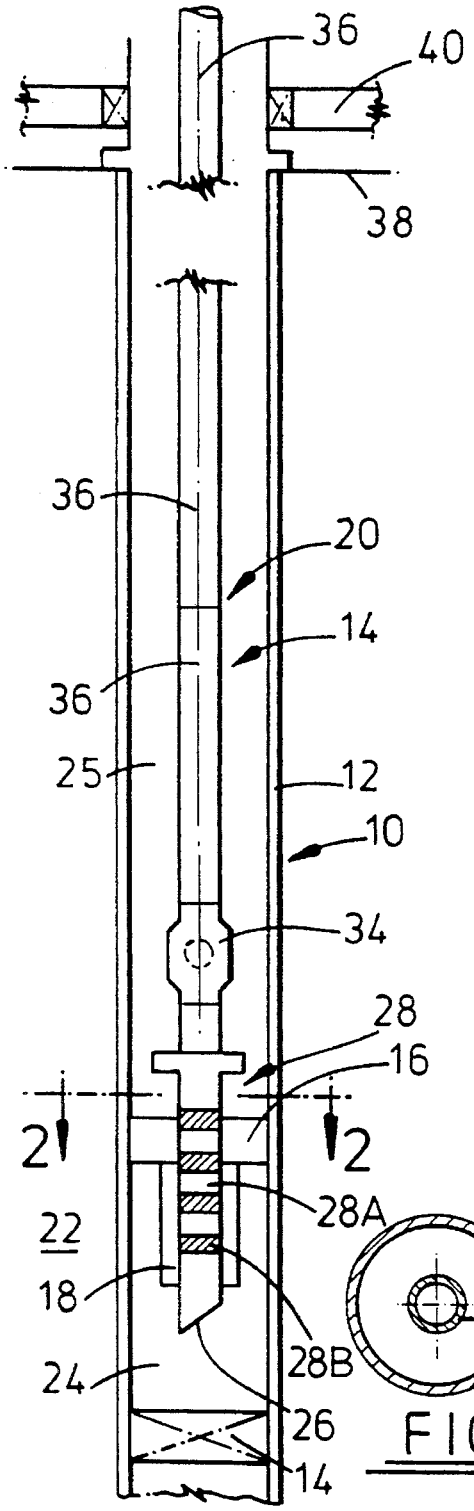
FIG. 1 is a diagrammatic view of a well casing with a test string assembly shown located in a downhole permanent packer.
Figure 2:
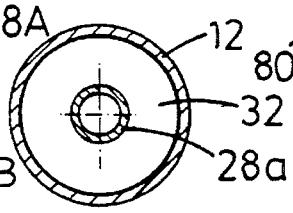
FIG. 2 is a cross-sectional view taken on the lines 2—2 of FIG. 1.

Reference is first made to FIGS. 1 and 2 of the drawings which depicts a diagrammatic view of a well generally indicated by reference numeral 10 which has casing 12 lining the well. Near the bottom 14 of the well is disposed a permanent packer generally indicated by reference numeral 16, which has a polished bore receptacle 18 for receiving the end of the test string generally indicated by reference numeral 20. The test string 20 is shown located in the packer for receiving test fluid from the formation 22 adjacent to closed volume 24 between the packer 16 and the bottom of the well 14. The close volume 24 may contain well fluid or formation fluid. If the casing is perforated then it may contain hydrocarbon fluid from the formation. The well bore 25 above the permanent packer 16 contains a fluid mud mixture of sufficient density to prevent blow out due to the downhole hydrocarbon pressure.

The test string 20 consists of various components which are, from the bottom up, a bullnose or wire line re-entry guide 26, a packer seal assembly 28 which consists of alternate bands of metal **28*a* and a Viton (trademark) elastomeric seal 28*b*, a locator no-go element 30 for abutting the top 32 of the packer 16, a tubing test valve 34 as will be later described in detail, and tubulars 36 or sufficient length to reach the surface. In the embodiment described the well bore is subsea and on the sea bed 38 is located a subsea BOP assembly which includes a set of hydraulic rams 40 for closing round the string in the well bore. The fluid surrounding the test string 20** is known as the annulus fluid and this can be increased in pressure via the BOP stack on the sea bed to actuate various subsea test tools and test valves as is well known in the art.

Figure 3:
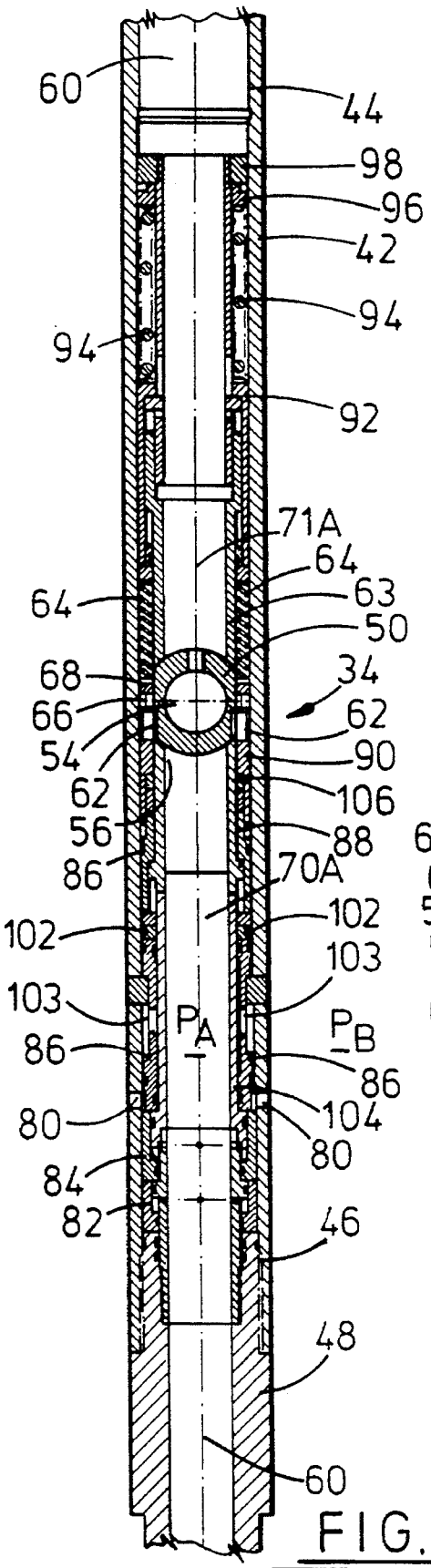
FIG. 3 is an enlarged longitudinal sectional view of a first embodiment of the tubing test valve shown in FIG. 1.

Reference is now made to FIG. 3 of the drawings which depicts the tubing test valve 34 in considerably more detail. FIG. 3 is the longitudinal sectional view through the assembled valve. The tubing test valve 34 consists of a valve housing 42 which is internally threaded at the top 44 for connection to a tubular and is internally threaded at the bottom 46 for connection to a bottom sub 48 for coupling to the locator no-go 30 and packer seal assembly 28. The internal structure of the housing is quite complex and will be best described with reference to the operations which the tubing test valve has to perform. The housing 42 contains a ball valve element 50 which is made of beryllium copper and which has a top aperture 52 and side apertures 54, only one of which is shown in FIG. 3. The ball 50 is adapted to rest on an annular metal valve seat 56 so that when the valve is closed as shown in FIG. 3 there is a metal-to-metal seal.

Figure 4:
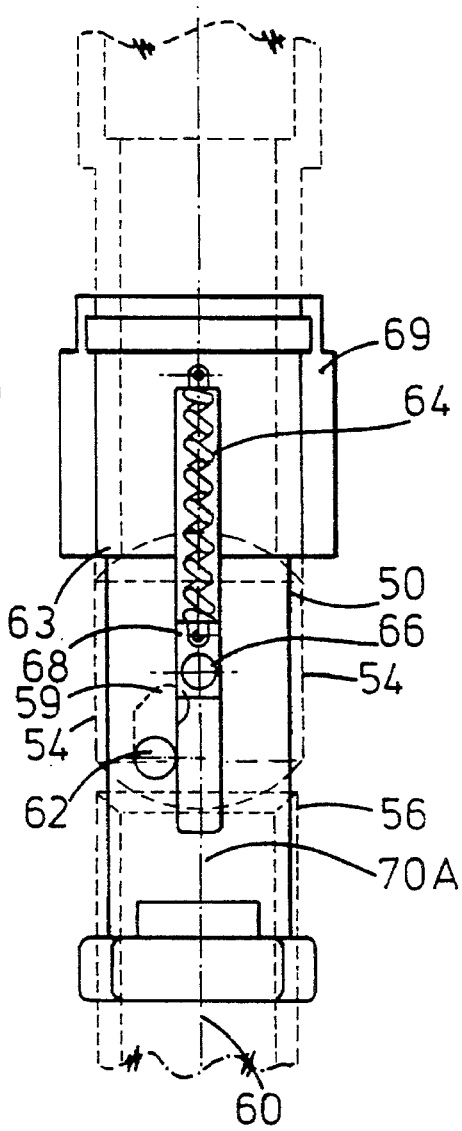

Reference is now also made to FIG. 4 of the drawings to clarify and explain the structure of the ball valve. The ball 50 has two generally J-shaped slots 58 which have portions 59 oriented at 45° to the longitudinal axis 60 of the test valve 34. The slots receive projections or ball pins 62 which act to retain the ball 50 in positions governed by the shape of the slots shown, but which also permit the ball 50 to rotate relative to the housing 36 and also to move axially along axis 60, as will be later described in detail, to fulfil certain functions. The ball 50 is suspended in the housing by two identical helical springs 64, only one of which is shown in FIG. 3. The springs 64 are secured to the centre spigots 66 of the ball 50 by brushings 68. The tops of the springs 64 are secured to ball cage 69 and are biased so that the ball 50 is normally raised upward and off the valve seat 56 in the absence of any forces or flow. This means that during running-in the ball 50 is raised off the valve seat 56 by the spring force, thus ensuring that the top aperture or flow orifice 52 controls the flow velocity and is the critical flow restrictor at all times.

As the test string is run in the hole the ball valve is self-filling; that is, the ball 50 is raised from the valve seat 56 by springs 64 such that the fluid in the bore hole flows up through the bore 70A of the valve around the ball valve through side apertures 54 and up through top aperture 52 in the direction of arrows shown in FIG. 4. It should also be understood that the flow rate through the valve 34 is governed by the aperture 52 in the upper face of the ball 50. This ensures that any erosion caused by the fluid and solids suspended within, travelling at high velocity, is restricted to the area of this aperture 52, hence any erosion will not affect the pressure integrity of the ball and seat arrangement. This means that the valve does not open and reseat every time flow from below pass through the valve, i.e. during running-in, as the tool is continually stopped and started as strands of drill pipe are added. Thus, the valve is only closed when pressure testing occurs, which is about 10 times in an average test procedure. The smaller number of opening-closures substantially improves the reliability of the valve to perform its primary function, i.e. to test the tubular assembly. The use of this aperture flow control technique is not restricted to this type of ball valve in tubing testing, but can be applied in any valve which is required to hold pressure in one direction and allow free flow in the other direction.

In order to pressure test the tubulars the run-in operation is stopped so that the string is stationery. To obtain a pressure test from above, fluid is pumped down the pipe at a rate of 1 gallon/second to create a pressure differential across the orifice aperture 52 and the resultant force overcomes the upward forces generated by the spigot springs 64 and forces the ball 50 off valve seat 63 onto the lower annular seat 56 forming a seal to support a pressure test. In this position the ball valve will support pressure from above of at least 15,000 p.s.i. and has been tested to 22,500 p.s.i. Thus, at each stage in the run-in operation when the integrity of the tubulars has to be tested, the tool is stopped and the pressure applied from above to pressure test a particular tubular combination. Once the pressure differential is released the spigot springs pull the valve away from the seat allowing free passage of fluid as before.

As described before the tool is lowered until locator no-go 30 abuts the top of the permanent packer 32 then spaced out and run-in again. This is the position shown in FIG. 1 of the drawings. In the arrangement shown in FIG. 1 the chamber beneath the permanent packer and the bottom of the well bore is closed.

In the embodiment shown the casing has not been perforated. Thus, the volume between the bottom 14 of the bore and the packer 16 is effectively closed. The test string is now required to be withdrawn from the packer. As described above, the prior art requires that a conventional tubing tester valve be fired open because the closed volume effectively creates a large hydraulic differential force across the tool. In situations even where the casing has been perforated this can still occur if the formation is impermeable which effectively acts as a closed volume.

In order to permit the string to be released from the packer a further operation is required using the tubing test valve. The tool is pulled upwards which results in a decrease in pressure within the valve bore 70A beneath the ball 50. This decrease in pressure results in a pressure differential between the interior of the bore, $P_a$, and the exterior of the bore, $P_b$. The differential pressure acts via bores 80 in the casing housing 42 to force pistons 82 and 84 upwards against main piston 86. The main piston 86 abuts a ball cage assembly, generally indicated by reference numeral 88,90, which causes the cage projections or ball to pins 62 to move relative ball slots 58. Similarly, the ball cage assembly 88,90 abuts an upper annulus spring pusher 92 and forces the main coil spring 94 upwards against an upper spring compressor 96 and spring retainer 98 at the top of the valve assembly.

Figure 8:
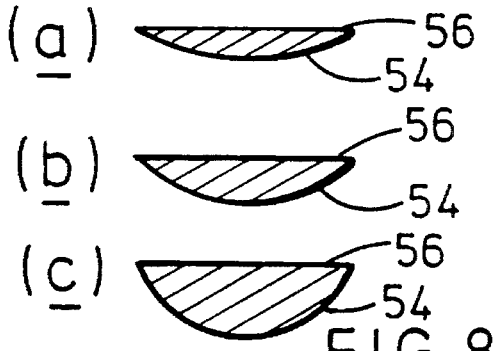
FIGS. 8*a*, 8*b* and 8*c* depict the amount of opening achieved by the ball valve in both embodiments in response to slow, medium and fast pull-up of the downhole test string when viewed in direction A of FIG. 7.

As the ball cage assembly 88,90 is moved up it urges the ball 50 to rotate relative to the valve housing 42 and axis 60 by virtue of the obliquely oriented slot portions 59. As the ball rotates it reaches a point where the aperture 54 breaks the seal between the exterior surface of the ball and the lower valve seat 56, as best shown in FIG. 8*a* of the drawings. When this occurs the pressure in the bore 71A above the ball 70A and the bore 70A below is equalised and thus the tool can be withdrawn to a certain extent from the permanent packer 16. However, as the pressure is equalised, the main coil spring 94 urges the ball cage assembly 88,90 down and hence the valve closes again. However, as there is a continued upward pull on the test string 20 a pressure differential is created as before and the ball 50 then again opens slightly. If the upward pull is continuous then the valve will oscillate between a closed and a slightly open position with the net effect being that the pressure equalisation will permit withdrawal of the test string 20 from the permanent packer 16 at a certain rate. For example, if the upwards pull rate is slow, then the degree of opening between the ball and the valve seat will be small as shown in FIG. 8*a*. If the rate of pull is increased, the opening will be larger as shown in FIG. 8*b* so that the opening will oscillate between this size of aperture and closed, and the aperture size for fast pull is shown in FIG. 8*c*.

The test string can now be partially retrieved to allow the various safety valves and hangers to be included. The positioning of this hanger can now been confidently predicted to enable the seal assembly to sit circa 50% into the PBR to allow for string contraction and expansion. As the tubing tester valve has not been locked open it still provides the ability to support a pressure test from above, hence enabling the safety valves and surface control valves after being installed to be pressure tested from the direction of the reservoir production, i.e. below. Once the test string is strung into the permanent packer prior to perforation, i.e. assembly 28, is sealed in the polished bore of the packer 16, the valve 34 can then be actuated to a fully open position.

In order to fully open the valve 34 and to lock it in the "fired open" position, pressure in the annulus 25 is increased such that the exterior pressure $P_{ext}$ is much greater than the interior bore pressure $P_{int}$ and this forces the main piston 86 up inside housing 42 such that the ball cage assembly 88,90 is moved up so that the ball 50 is rotated so that the valve is fully open, that is, the passage 54 mates with the interior bores 70A,71A of the valve 34. In this position spring-loaded locking dogs 102 are forced out between the mandrel 104 and the bottom valve seat cage 106 to lock the ball cage assembly in that position against the restoring force of the main coil spring 94. When this occurs the valve 34 is fully open to allow various testing operations.

After the string is withdrawn the tool can be stripped down and re-set for subsequent operations. The strip-down and maintenance procedure takes only about 20 minutes before the tool is re-usable.

A further embodiment is described with reference to FIGS. 5, 6, 7, and 8 of the drawings which is the same as the first embodiment except for the way in which the ball element is mounted leading to a different operating method. For convenience, like numerals refer to like pares with suffix "a" added.

Figure 5:
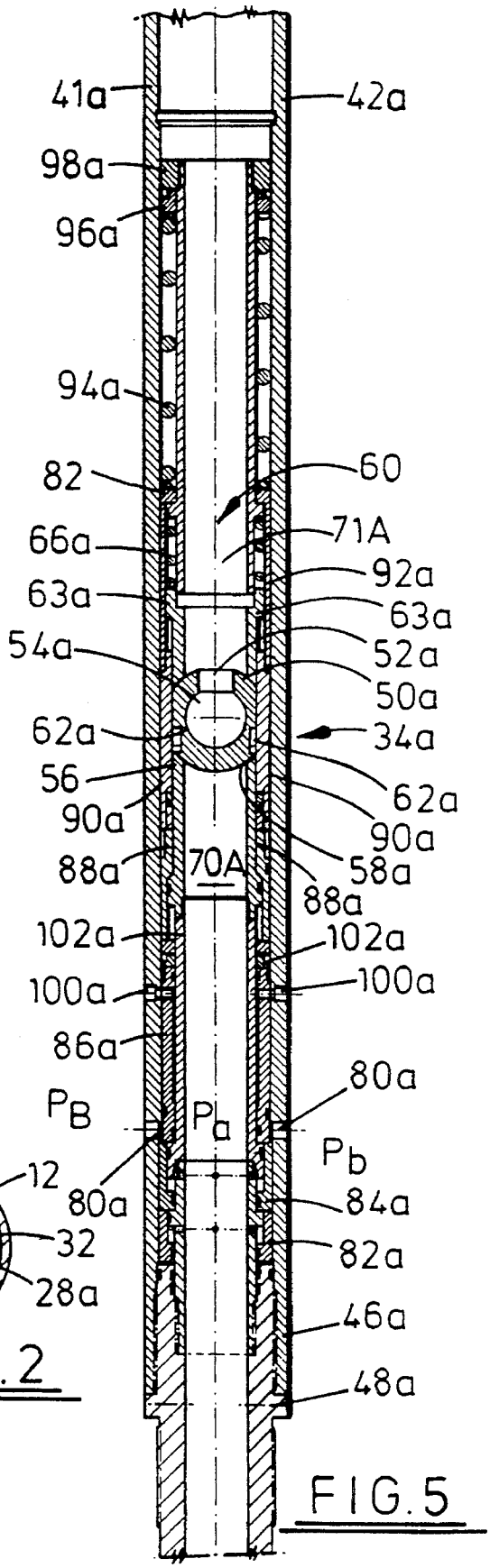
FIG. 5 is a view similar to FIG. 3 of an alternative embodiment of tubing test valve.

Reference is now made to FIGS. 5, 6, 7 and 8 of the drawings which depicts the tubing test valve 34*a* in considerably more detail. FIG. 5 is the longitudinal sectional view through the assembled valve. The tubing test valve 34*a* consists of a valve housing 42*a* which is internally threaded at the top 44*a* for connection to a tubular and is internally threaded at the bottom 46*a* for connection to a bottom sub 48*a* for coupling to the locator no-go 28*a* and packer seal assembly. The internal structure of the housing is quite complex and will be best described with reference to the operations which the tubing test valve has to perform. The housing 34*a* contains a ball valve element 50*a* Which is made of beryllium copper and which has a top aperture 52*a* and side apertures 54*a*, only one of which is shown in FIG. 5. The ball 50 rests on an annular metal valve seat 56 so that when the valve is closed as shown in FIG. 5 there is a metal-to-metal seal.

Figure 6:
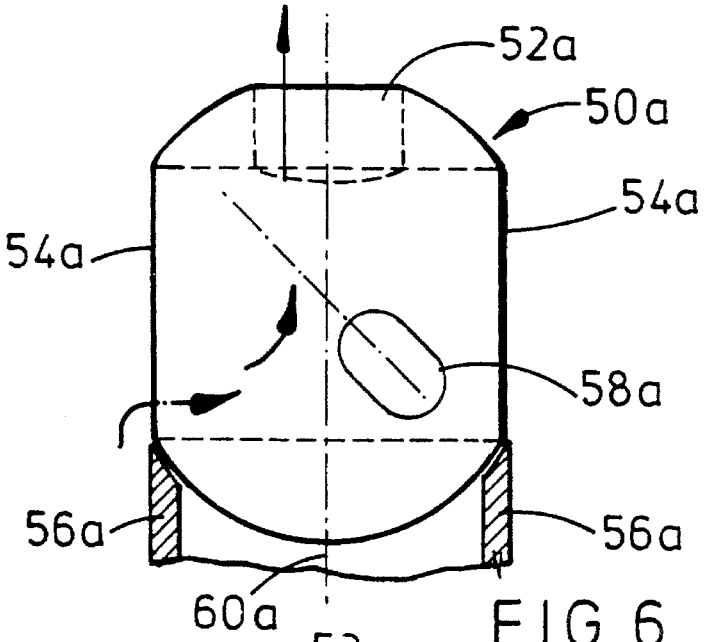
FIG. 6 is an enlarged side view of the ball valve shown in FIG. 4.
Figure 7:
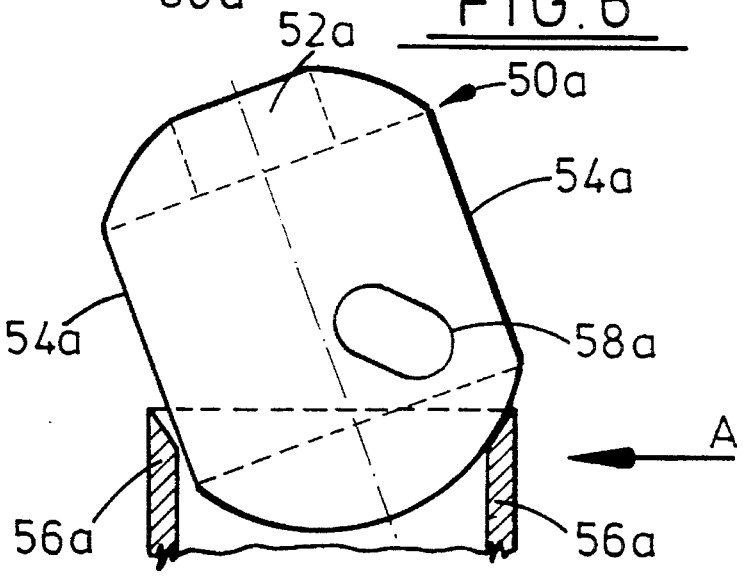
FIG. 7 is a similar view to FIG. 4 with the ball valve being rotated to a partly open position during pull up of the test string.

Reference is now also made to FIGS. 6 and 7 of the drawings to clarify and explain the structure of the ball valve. The ball 50 has two generally oval slots 58*a* which are oriented at 45° to the longitudinal axis 60*a* of the test valve 34*a*. The slots receive projections or ball pins 62*a* which act to retain the ball 50*a* in approximate positions shown, but which also permit the ball 50*a* to rotate relative to the housing 42*a* and also to move axially along axis 60*a*, as will be later described in detail, to fulfil certain functions.

As the test string is run in the hole the ball valve is self-filling; that is, the ball 50*a* is forced off valve seat 56*a* such that the fluid in the bore hole flows up through the bore 70A of the valve around the ball valve through side apertures 54*a* and up through top aperture 52*a* in the direction of arrows shown in FIG. 7. This is achieved because the ball 50*a* is forced upwards forcing upper valve seat 63*a* against upper valve seat coil spring 66*a* which permits the ball 50*a* to move free of the valve seat 56*a*. It should also be understood that the flow rate through the valve 34*a* is governed by the aperture 52*a* in the upper face of the ball 50*a*. This ensures that any erosion caused by the fluid and solids suspended within, travelling at high velocity, is restricted to the area of this aperture 52*a*, hence any erosion will not affect the pressure integrity of the ball and seat arrangement. This substantially improves the reliability of the valve to perform its primary function, i.e. to test the tubular assembly. The use of this aperture flow control technique is not restricted to this type of ball valve in tubing testing, but can be applied in any valve which is required to hold pressure in one direction and allow free flow in the other direction.

In order to pressure test the tubulars the run-in operation is stopped so that the string is stationery. When this occurs the pressure of coil spring 66*a* urges the upper valve seat 63*a* against the ball 50*a* and forces it back on to the lower valve seat 56*a*. In this position the ball valve will support pressure from above of at least 15,000 p.s.i. and has been tested to 22,500 p.s.i. Thus, at each stage in the run-in operation when the integrity of the tubulars has to be tested, the tool is stopped and the pressure applied from above to pressure test a particular tubular combination.

As described before the tool is lowered until locator no-go 30 abuts the top of the permanent packer 32 then spaced out and run-in again. This is the position shown in FIG. 1 of the drawings. In the arrangement shown in FIG. 1 the chamber beneath the permanent packer and the bottom of the well bore is closed.

In the embodiment shown the casing has not been perforated. Thus, the volume between the bottom 14 of the bore and the packer 16 is effectively closed. The test string is now required to be withdrawn from the packer. As described above, the prior art requires that a conventional tubing tester valve be fired open because the closed volume effectively creates a large hydraulic differential force across the tool. In situations even where the casing has been perforated this can still occur if the formation is impermeable which effectively acts as a closed volume.

In order to permit the string to be released from the packer a further operation is required using the tubing test valve. The tool is pulled upwards which results in a decrease in pressure within the valve bore 70A beneath the ball 50*a*. This decrease in pressure results in a pressure differential between the interior of the bore, $P_a$, and the exterior of the bore, $P_b$. The differential pressure acts via bores 80*a* in the casing housing 42*a* to force pistons 82*a* and 84*a* upwards against main piston 86*a*. The main piston 86*a* abuts a ball cage assembly, generally indicated by reference numeral 88*a*,90*a*, which causes the cage projections or ball pins 62*a* to move within ball slots 58*a*. Similarly, the ball cage assembly 88*a*,90*a* abuts an upper annulus spring pusher 92*a* and forces the main coil spring 94*a* upwards against an upper spring compressor 96*a* and spring retainer 98*a* at the top of the valve assembly.

As the ball cage assembly 88*a*,90*a* is moved up it urges the ball 50*a* to rotate relative to the valve housing 42*a* and axis 60*a* by virtue of the obliquely oriented slots 58*a*. As the ball rotates it reaches a point where the aperture 54*a* breaks the seal between the exterior surface of the ball and the lower valve seat 56*a*, as best shown in FIG. 7 of the drawings. When this occurs the pressure in the bore 71A above the ball 50*a* and the bore 70A below is equalised and thus the tool can be withdrawn to a certain extent from the permanent packer 16. However, as the pressure is equalised, the main coil spring 94*a* urges the ball cage assembly 88*a*,90*a* down and hence the valve closes again. However, as there is a continued upward pull on the test string 20 a pressure differential is created as before and the ball 50*a* then again opens slightly. If the upward pull is continuous then the valve will oscillate between a closed and a slightly open position with the net effect being that the pressure equalisation will permit withdrawal of the test string 20 from the permanent packer 16 at a certain rate. For example, if the upwards pull rate is slow, then the degree of opening between the ball and the valve seat will be small as shown in FIG. 8*a*. If the rate of pull is increased, the opening will be larger as shown in FIG. 8*b* so that the opening will oscillate between this size of aperture and closed, and the aperture size for fast pull is shown in FIG. 8*c*.

The test string can now be partially retrieved to allow the various safety valves and hangers to be included. The positioning of this hanger can now been confidently predicted to enable the seal assembly to sit circa 50% into the PBR to allow for string contraction and expansion. As the tubing tester valve has not been locked open it still provides the ability to support a pressure test from above, hence enabling the safety valves and surface control valves after being installed to be pressure tested from the direction of the reservoir production, i.e. below. Once the test string is strung into the permanent packer prior to perforation, i.e. assembly 28, is sealed in the polished bore of the packer 16, the valve 34 can then be actuated to a fully open position.

In order to fully open the valve 34*a* and to lock it in the "fired open" position, pressure in the annulus 25 is increased such that the exterior pressure $P_{ext}$ is much greater than the interior bore pressure $P_{int}$ and this forces the main piston 86*a* up passed the piston limit shearing shear pins 100*a*. When the shear pins 100*a* are sheared, the ball cage assembly 88*a*,90*a* is moved up so that the ball 50*a* is rotated so that the valve is fully open, that is, the passage 54*a* mates with the interior bores 70A,71A of the valve 34*a*. In this position spring-loaded dogs 102*a* are forced out to lock the ball cage assembly in that position against the restoring force of the main coil spring 94*a*. When this occurs the valve 34*a* is fully open to allow various testing operations.

After the string is withdrawn the tool can be stripped down and re-set for subsequent operations. The strip-down and maintenance procedure takes only about 20 minutes before the tool is re-usable.

It will be appreciated that various modifications may be made to the embodiments hereinbefore described without departing from the scope of the invention. For example, the tool may be used with retrievable packers and may be used with both floating rigs, such as drilling ships and semi-submersibles, as well as production platforms and land rigs. It may be used in both cased and uncased holes and is particularly suitable for use in high pressure wells, that is wells greater than 8,000 p.s.i. which generally tend to be deep wells, perhaps of the order of 15,000 or 16,000 feet. It will also be appreciated that the valve may be used with a test string where the bottom formation is cased, perforated or not perforated, or may be used with a bottom formation which has a permanent packer, but not casing below the packer. The ball valve may be replaced with a plug valve which permits unidirectional flow in a high pressure flow system, and holds high pressure in the other direction. The plug valve is rotatable between an opened and closed position and is also axially moveable to self-fill during run-in.

It will appreciated that the components and materials used in the construction of the tubing test valve comply with the Sour Service capability specified by Nace MR 0175 which is an A.P.I. standard.

In the second embodiment it will also be appreciated that the size of the coil springs is fine tuned to operate over a range of typical downhole pressures and this has been achieved by straightforward trial and error. The coil springs of both embodiments may be replaced by any other suitable resilient means, such as an elastomeric sleeve or a belleville-type washer.

Therefore, the tubing test valve hereinbefore described utilises standard components and may be readily assembled in a relatively short period of time. In addition, after operation the tool can be re-set for re-use within a very short period of time. The tool has the advantage in that it allows self-filling during run-in and also permits pressure testing of both the tubulars in order to locate the assembly in the permanent packer and also permits pressure testing of the test apparatus once a space-out has been performed. Furthermore, it permits by-pass during tool retrieval to allow relatively easily withdrawal of the tool from a permanent packer in a closed or tight formation. A further advantage is that the tool permits multiple entry to permanent packers without the tool being committed to the locked open position.

We claim:

1. A tubing nest valve for use in a drill string insertable into a permanent packer of a well during well running-in operations, said tubing test valve comprising:

a valve housing;

a rotatable valve element disclosed in the valve housing, aid rotatable valve element being rotatable and axially movable along the longitudinal axis of the valve housing;

a valve seat disposed in the valve housing for engagement with the valve element;

valve element positioning means for positioning the valve element axially above the valve seat during running-in a well, and for positioning the valve element to engage the valve seat when the tubing test valve is stationary in the well to allow pressure testing of components above the valve element, and resiliently-biased valve cage means for supporting said rotatable valve element in said valve housing, said resiliently-biased cage means being axially moveable within said valve housing and including means for rotating the valve element in response to an upward pull on said test valve when said drill string is located in said packer to a partly open position to equalize pressure across the valve element so that the drill string can be withdrawn from the packer.

2. A valve as claimed in claim 1 wherein the valve element positioning means is spring means coupled between the valve element and the valve cage means, said spring means being biased to raise said valve element off said valve seat when running-in said well, said spring means allowing said ball element to engage said valve seat when fluid is pumped through said valve housing from above.

3. A valve as claimed in claim 2 wherein the spring means comprises two coil springs.

4. A valve as claimed in claim 1 wherein the valve element positioning means is a spring means disposed above the valve element and arranged to bias said valve element into engagement with the valve seat when the tubing test valve is stationary in the well, and to allow fluid in said well to push said valve element away from the valve seat during running-in whereby well fluid can flow through said tubing test valve.

5. A valve as claimed in claim 4 wherein the spring means is a coil spring and the valve further comprises a second valve seat slidingly disposed in the valve housing, said coil spring being coupled to said second valve seat for forcing said second valve seat into engagement with a top surface of said valve element when said valve is stationary in the well.

6. A tubing test valve for use in a drill string insertable into a permanent backer of a well bore during well running-in operations, said tubing test valve comprising:

a valve housing;

a valve seat disposed in the valve housing;

a rotatable valve element disposed in said valve housing, said rotatable valve element being rotatable and being axially moveable along the longitudinal axis of the valve housing;

spring means for biasing said rotatable valve element off said valve seat when running the drill string, in a well to allow fluid to freely enter the test string, said spring means being responsive no fluid pumped through said valve housing to close said rotatable valve element when the tubing test valve is stationary in the well, and resiliently-biased valve cage means for supporting said rotatable valve element in said housing, said resiliently-biased cage means being axially moveable within said valve housing and including means for rotating the valve element in response to an upward pull on said test valve when said drill string is located in said packer to a partly open position to equalize pressure across the valve element so that the drill string can be withdrawn from the packer.

7. A valve as claimed in claim 6 wherein the valve element is a ball valve element.

8. A valve as claimed in claim 7 wherein the ball valve element includes generally J-shaped slots oriented at an oblique angle to the longitudinal axis of the valve housing for receiving spigots disposed on said resiliently-biased valve cage means to permit rotation of the ball valve element in response to an upward movement of said valve cage means, such that the ball valve element is rotated off of the valve seat to partly open the valve and equalize pressure above and below the ball valve element.

9. A valve as claimed in claim 7 wherein the resiliently-biased valve cage means includes first and second annular pistons disposed downstream of the ball valve element, said annular pistons being axially moveable within said valve housing, and the test valve further includes means responsive to a pressure differential between internal and external pressures of well tubing disposed beneath the permanent packer created by upward pull on the test valve when said drill string is located in the permanent packer for forcing the pistons up to cause the ball valve element to rotate to a partly open position and allow withdrawal of the drill string from the permanent packer.

10. A valve as claimed in claim 6 wherein the spring means is a pair of coil springs coupled between the valve element and the valve cage means and the resiliently-biased valve cage means includes a second coil spring disposed in the valve housing above said valve cage means to urge said cage toward said valve seat.

11. A valve as claimed in claim 6 wherein the test valve includes pressure sensitive means actuatable in response to a pre-determined pressure differential between an interior and an exterior of the well bore to lock the tubing test valve fully open when the drill string is withdrawn from the packer.

12. A valve as claimed in claim 6 wherein the valve seat comprises an annular metal seal so that metal-to-metal seals are provided by said tubing test valve.

13. A valve as claimed in claim 1 wherein the valve element further comprises:

a ball valve element in said valve housing, said ball valve element being coupled by spring means to the ball cage so as to be biased off an annular valve seat such that, when the ball valve element is disposed off the annular valve seat to cause an interruption of an interface between the ball valve surface and the annular valve seat, the valve is open and, during the running-in of a drill string into a well, fluid can flow through said valve, and when the drill string is stationary within said packer and force is applied to the ball valve element from above, it seats on the annular valve seat to close the valve, said ball valve element having at least one aperture through a side thereof and at least one aperture through a top thereof, said apertures being connected by a channel, the ball valve element being rotatably displaced from the annular valve seat during said ball surface/valve seat interface interruption such that fluid may pass in one direction past said annular valve seat through said side aperture, said channel and out through said top aperture.

14. A valve as claimed in claim 13 wherein said ball valve element includes at least two side apertures connected by a common channel and one top aperture which is connected by a second channel to said common channel.

15. A valve as claimed in claim 14 wherein said common channel is disposed substantially transverse with respect to said second channel, and said ball valve element further includes a pair of side slots adapted to receive a pair of spigots disposed on the ball cage for retaining the ball valve element in the ball cage, whereby the ball valve element is free to rotate and move axially by a limited amount within said valve housing.

16. A valve as claimed in claim 1 wherein the valve element further comprises:

a ball valve element mounted in said valve housing for engagement with said annular valve seat such that, when the a drill string is stationary within a packer and upward force is applied to the ball valve, the ball valve element engages the valve seat to create a ball valve surface/valve seat interface, to close the ball valve, and when the ball valve element is axially rotatably displaced out of engagement with the annular valve seat during the running-in of the drill string into a well to interrupt the ball surface/valve seat interface, the ball valve is open so that fluid can flow through said ball valve, said ball valve element having at least one aperture in a side thereof and at least one aperture in a top thereof, said apertures being connected by a channel such that, when the ball valve element is open, fluid may pass in one direction past said annular valve seat through said side aperture, said channel and out through said top aperture.

17. A ball valve as claimed in claim 16 wherein said ball valve element includes at least two side apertures connected by a common channel and one top aperture which is connected by a second channel to said common channel.

18. A ball valve as claimed in claim 16 wherein said ball valve element includes at least two side apertures substantially transversely connected to each other, and a pair of side slots being adapted to receive a pair of spigots pair of disposed in said valve housing for retaining the ball valve element in a ball cage assembly whereby the ball valve element is free to rotate and move axially by a limited amount within said valve housing.

19. A tubing test valve for use in a drill string insertable into a permanent packer of a well during well running-in operations, said tubing test valve comprising:

a valve housing;

a rotatable valve element disposed in said valve housing, said rotatable valve element being rotatable and being axially moveable along the longitudinal axis of the valve housing;

first spring means for permitting said rotatable valve element to move axially when running the drill string in a well to allow fluid to freely enter the test valve, said first spring means closing said rotatable valve element when the test valve is stationary in the well, and resiliently-biased valve cage means for supporting said rotatable valve element in said housing, said resiliently-biased valve cage means being axially moveable within said valve housing and including means for rotating the valve element in response to an upward pull on said test valve when said drill string is located in said packer to a partly open position to equalize pressure across the valve element so that the drill string can be withdrawn from the packer.

20. A valve as claimed in claim 19 wherein the valve element is a ball valve element.

21. A valve as claimed in claim 19 wherein the valve element is a plug valve element.

22. A valve as claimed in claim 19 wherein the first spring means is a first coil spring and the resiliently-biased valve cage means includes a second coil spring disposed in the valve housing above said valve cage means to urge said cage downward.

23. A valve as claimed in claim 19 wherein the test valve includes pressure sensitive means responsive to a predetermined annulus pressure to lock the tubing test valve fully open when the drill string is withdrawn from the packer.

24. A valve as claimed in claim 19 wherein the valve element includes slots oriented at an oblique angle to the longitudinal axis of the valve housing for receiving spigots disposed on said resiliently-biased valve cage means to permit rotation of the valve element, and the valve housing further includes a valve seat disposed below the valve element such that, in response to an upward movement of said valve cage means, the valve element is rotated clear of the valve seat so that the test valve is to partly open and pressure above and below the valve element is equalised.

25. A valve as claimed in claim 19 wherein the resiliently-biased valve cage means includes first and second annular pistons dispose downstream of the valve element, said annular pistons being axially moveable within said valve housing, and means responsive to a pressure differential between internal and external pressures of well tubing disposed beneath the permanent packer created by upward pull on the test valve when said drill string is located in the permanent packer for forcing the pistons up to the valve element to rotate a partly open position and allow withdrawal of the drill string from the permanent packer.

26. A method of withdrawing a test string from a permanent packer, said method comprising the steps of:

providing a tubing test valve having a housing and a rotatable valve element disposed therein, said rotatable valve element being rotatable and axially moveable within the test valve housing, pulling upward on the test string when located in said permanent packer to create a pressure differential between the interior and exterior of well tubing disposed beneath said permanent packer, and using said differential pressure to open said valve to equalise pressures above and below the valve element within the tubing test valve to permit the test string to be withdrawn from the permanent packer.

* * * * *